US006762665B1

(12) United States Patent
Iwai et al.

(10) Patent No.: US 6,762,665 B1
(45) Date of Patent: Jul. 13, 2004

(54) MAGNET ROLLER

(75) Inventors: Masaharu Iwai, Mooka (JP); Masami Hosokawa, Mooka (JP)

(73) Assignees: Kaneka Corporation, Osaka (JP); Tochigi Kaneka Corporation, Mooka (JP)

( * ) Notice: Subject to any disclaimer, the term of this patent is extended or adjusted under 35 U.S.C. 154(b) by 73 days.

(21) Appl. No.: 09/868,907

(22) PCT Filed: Nov. 7, 2000

(86) PCT No.: PCT/JP00/07811

§ 371 (c)(1),
(2), (4) Date: Jul. 9, 2001

(87) PCT Pub. No.: WO01/35426

PCT Pub. Date: May 17, 2001

(30) Foreign Application Priority Data

Nov. 10, 1999 (JP) ..... 11-319330

(51) Int. Cl.[7] ..... H01F 7/02
(52) U.S. Cl. ..... 335/306; 399/276
(58) Field of Search ..... 399/276–277; 335/302–306

(56) References Cited

U.S. PATENT DOCUMENTS 4,557,582 A * 12/1985 Kan et al. ..... 399/267

FOREIGN PATENT DOCUMENTS

JP 2-222110 * 9/1990
JP 10-308308 11/1998

* cited by examiner

*Primary Examiner*—Lincoln Donovan
(74) *Attorney, Agent, or Firm*—Armstrong, Kratz, Quintos, Hanson & Brooks, LLP

(57) ABSTRACT

The object is to provide a magnet roller whereby picture quality can be improved by raising the magnetic flux density of the specified magnetic pole and/or other magnetic poles, and wherein this magnetic pole pattern can be achieved with low cost. In a magnet roller (10) according to the invention that achieves this object, a plurality of magnet pieces (12, 14, 16, 18) are mounted at the periphery of a shaft (20) by joining at joining faces and peaks (32*a*, 34*a*, 36*a*, 38*a*) of magnetic poles (32, 34, 36, 38) are generated on the lines of extension of joining faces (13, 15, 17, 19) by setting the directions of orientation magnetization (22, 24, 26, 28) of adjacent magnet pieces (12, 14, 16, 18) facing the joining faces (13, 15, 17, 19), the respective joining faces (13, 15, 17, 19) of the plurality of magnet pieces (20) being provided along the roller radial directions.

5 Claims, 9 Drawing Sheets

MAGNET ROLLER

BACKGROUND OF THE INVENTION

1. Field of the Invention

The present invention relates to a magnet roller, and relates to a magnet roller in which a plurality of magnet pieces are joined at joining faces.

2. Description of the Related Art

Conventionally, magnet rollers are employed in for example copiers of the electrophotographic type, facsimile machines and laser printers. An example of such a magnet roller is the type, called the "joined type", in which the magnetic field pattern is formed by joining a plurality of magnet pieces which are magnetized with their magnetic grains aligned unidirectionally.

Joined type magnet rollers are employed in developing devices for high picture quality, since they make possible the formation of a sharp magnetic field pattern. However, there are limits to the extent to which the magnetic flux density of the developing pole of the magnetic field pattern in such a magnet roller (hereinbelow called "specified magnetic pole") can be raised, which made further improvement in picture quality difficult to achieve.

Accordingly, in Laid-open Japanese Patent Publication No. H11-65283 "magnet roller", the present inventors proposed a method of considerably raising the magnetic flux density of the specified magnetic pole by constituting this specified magnetic pole of a combination of two magnet pieces. This made it possible to further improve picture quality.

However, in the magnet roller of the above publication, two magnet pieces are required in order to raise the magnetic flux density of a single specified magnetic pole. The number of magnet pieces therefore became large, making it difficult to raise productivity in respect of the magnet roller and making it difficult to lower production costs.

Recently, high magnetic force has come to be required even for poles other than the specified magnetic pole (developing pole), such as for example the pole for restricting the layer thickness of the developer; thus high magnetic force has come to be required in two or more magnetic poles in a single magnet roller. For example, if high magnetic force is required for two magnetic poles in a single magnet roller, with the magnet roller of the above publication, four magnet pieces would be necessary in order to provide magnetic poles of high magnetic force.

The number of magnet pieces was thereby further increased, further increasing the difficulty of improving productivity of the magnet roller, and making it more difficult to lower production costs.

SUMMARY OF THE INVENTION

The present invention was made in view of the above problems, an object thereof being to provide a magnet roller wherein picture quality can be further improved by raising the magnetic flux density of the specified magnetic pole and/or other magnetic poles, and wherein a magnetic pole pattern with improved magnetic flux density of this specified magnetic pole and/or other magnetic poles can be achieved with low cost.

In order to achieve the above object, according to the present invention, in a magnet roller according to the present invention, wherein a plurality of magnet pieces are mounted at the periphery of a shaft by joining at joining faces, peaks of magnetic poles are generated on the lines of extension of the joining faces by setting the directions of orientation magnetization of adjacent magnet pieces facing the joining faces, the respective joining faces of the plurality of magnet pieces being made to coincide with roller radial directions of this magnet roller.

With a magnet roller according to the present invention constructed in this way, the respective joining faces of the plurality of magnet pieces are made to coincide with roller radial directions and the orientation magnetization directions of adjacent magnet pieces are set facing the joining faces. Consequently, repulsive magnetic fields are generated at the joining faces, and the peaks of magnetic poles can be generated on the lines of extension of the joining faces.

By causing the magnetic poles to be formed by the repulsive magnetic fields at the joining faces, high magnetic force can be obtained at a plurality of magnetic poles (specified magnetic pole and other magnetic poles).

Also, the peaks of the magnetic poles are caused to be generated on the lines of extension of the joining faces by making the respective joining faces of the plurality of magnet pieces coincide with radial directions of the roller. Consequently, the number of magnet pieces can be made the same as the number of magnetic poles required or can be restricted to the number of magnetic poles required +1.

Consequently, the productivity of the magnet roller can be raised, and production costs can be lowered.

According to the present invention, the sum of the angles of the orientation magnetization directions of at least one set of the adjacent magnet pieces is set at 30° to 140°.

By setting the sum of the angles of the orientation magnetization directions of at least one set of the adjacent magnet pieces at 30° to 140°, it can be arranged for the repulsive magnetic field to be generated in the most efficient manner. The magnetic flux density of for example the specified magnetic pole can therefore be made sufficiently large.

According to the present invention, the orientation magnetization directions of at least one set of the adjacent magnet pieces are made to converge towards the outside of the joining face.

By making the orientation magnetization directions of at least one set of the adjacent magnet pieces converge towards the outside of the joining face, the magnetic path length is made longer, thereby increasing the coefficient of permeance and making it possible to generate a repulsive magnetic field in most efficient manner. The magnetic flux density of for example the specified magnetic pole can thereby be raised even further.

DESCRIPTION OF THE PREFERRED EMBODIMENTS

Figure 1:
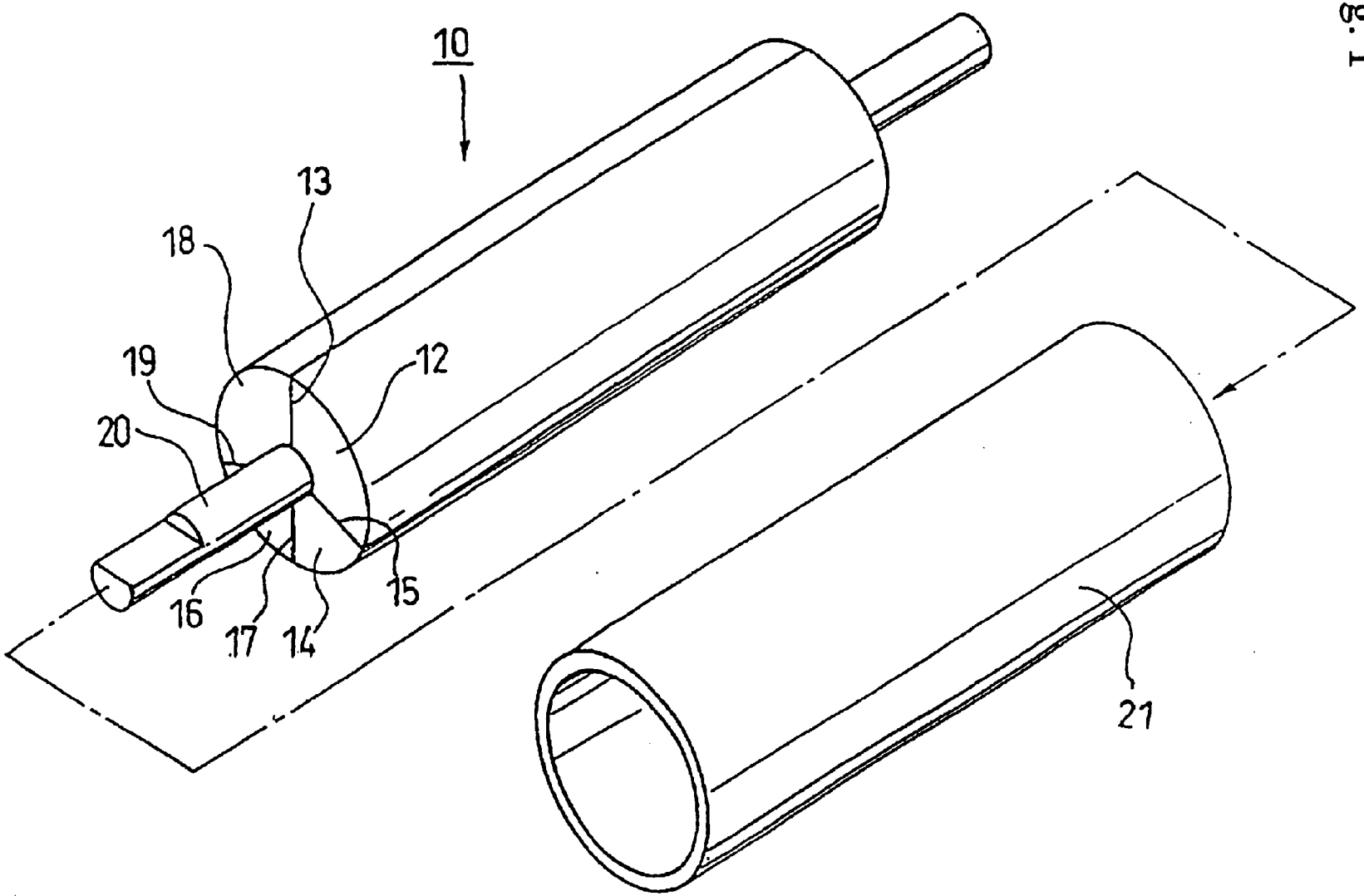
FIG. 1 is a perspective view of a magnet roller illustrating a first embodiment of the present invention.
Figure 2:
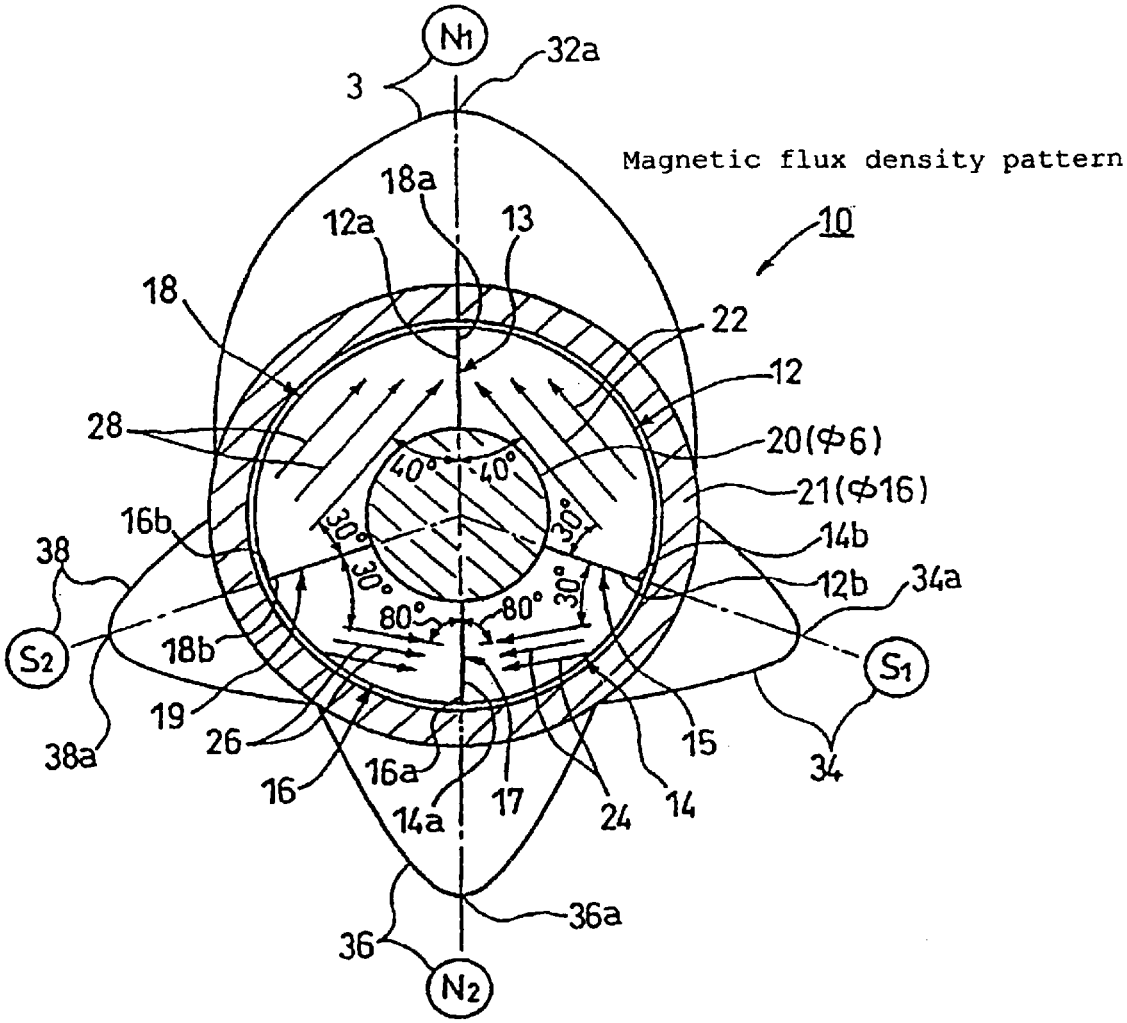
FIG. 2 is a cross-sectional view of a magnet roller illustrating a first embodiment of the present invention, showing a magnetic flux density pattern of a magnet roller.
Figure 3:
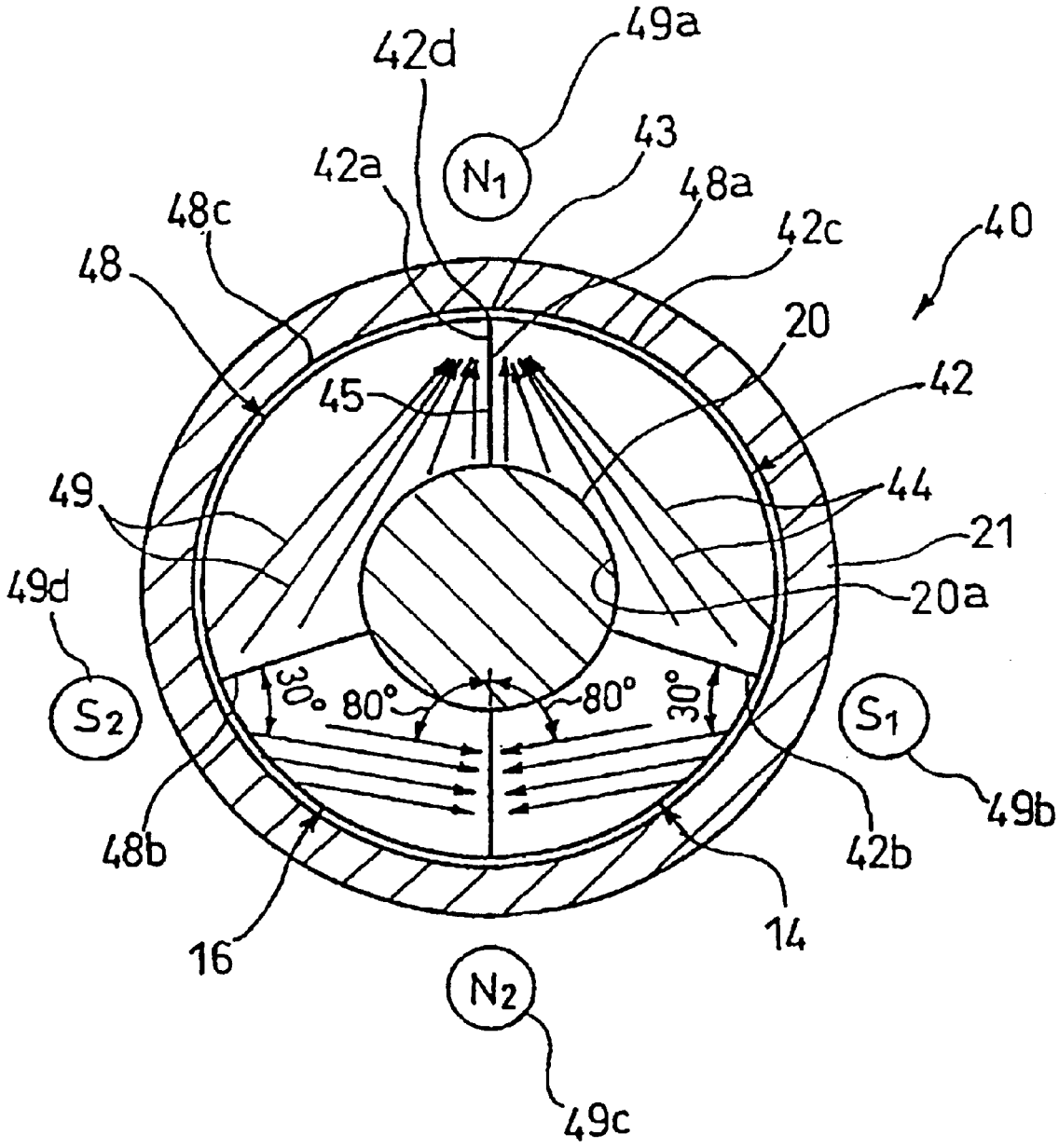
FIG. 3 is a cross-sectional view of a magnet roller illustrating a second embodiment of the present invention.
Figure 4:
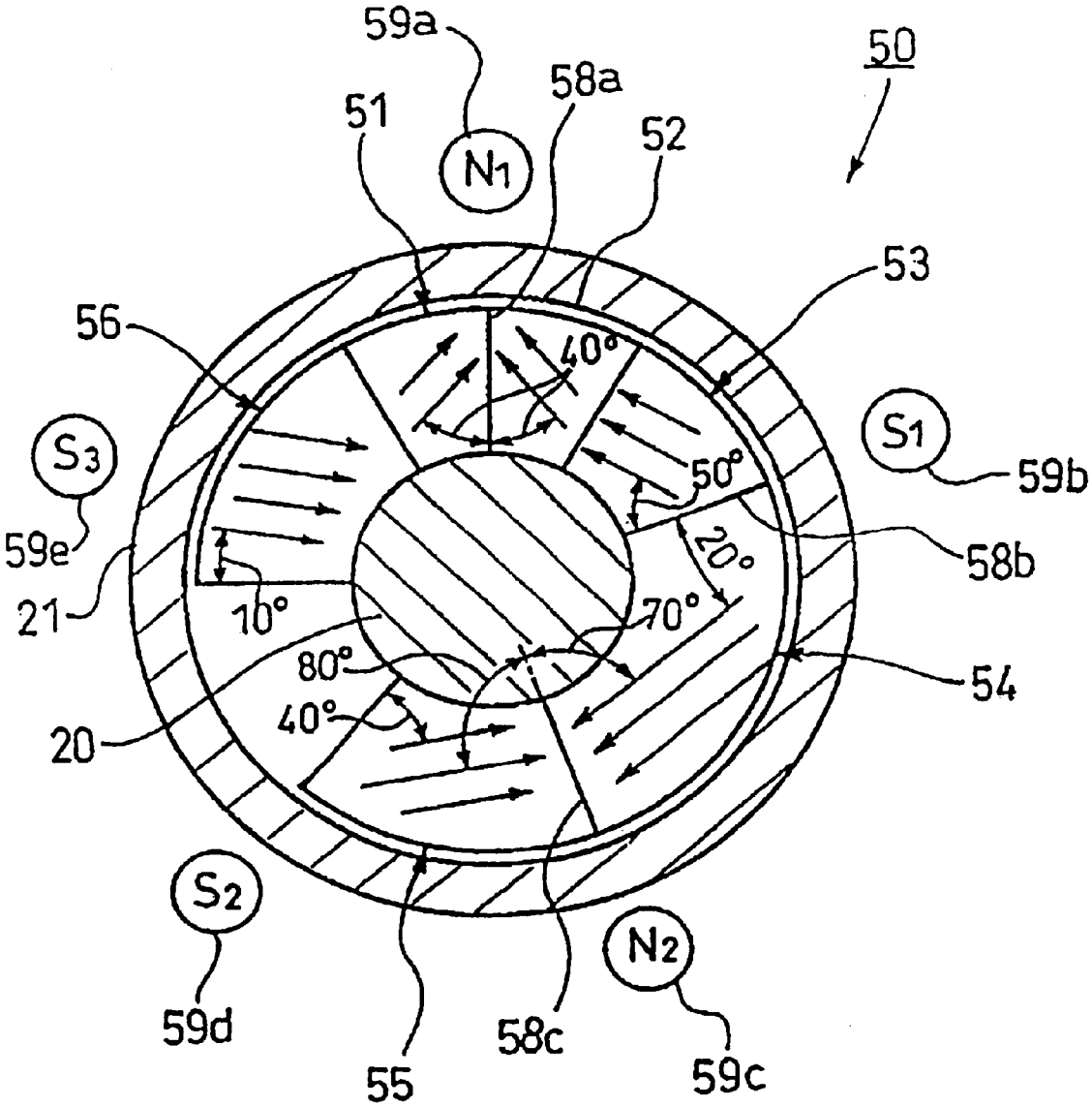
FIG. 4 is a cross-sectional view of a magnet roller illustrating a third embodiment of the present invention.
Figure 5:
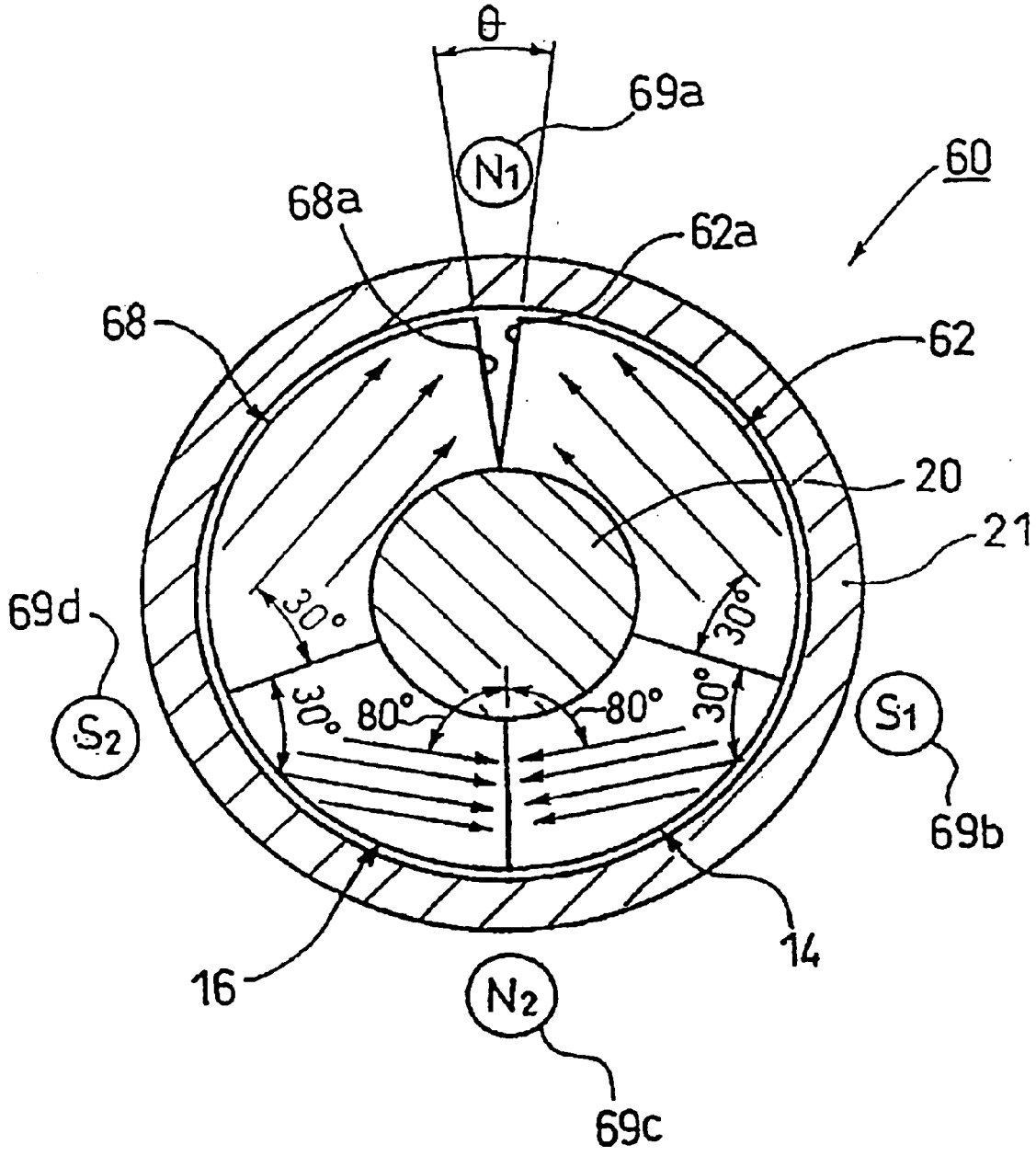
FIG. 5 is a cross-sectional view of a magnet roller illustrating a fourth embodiment of the present invention.
Figure 6:
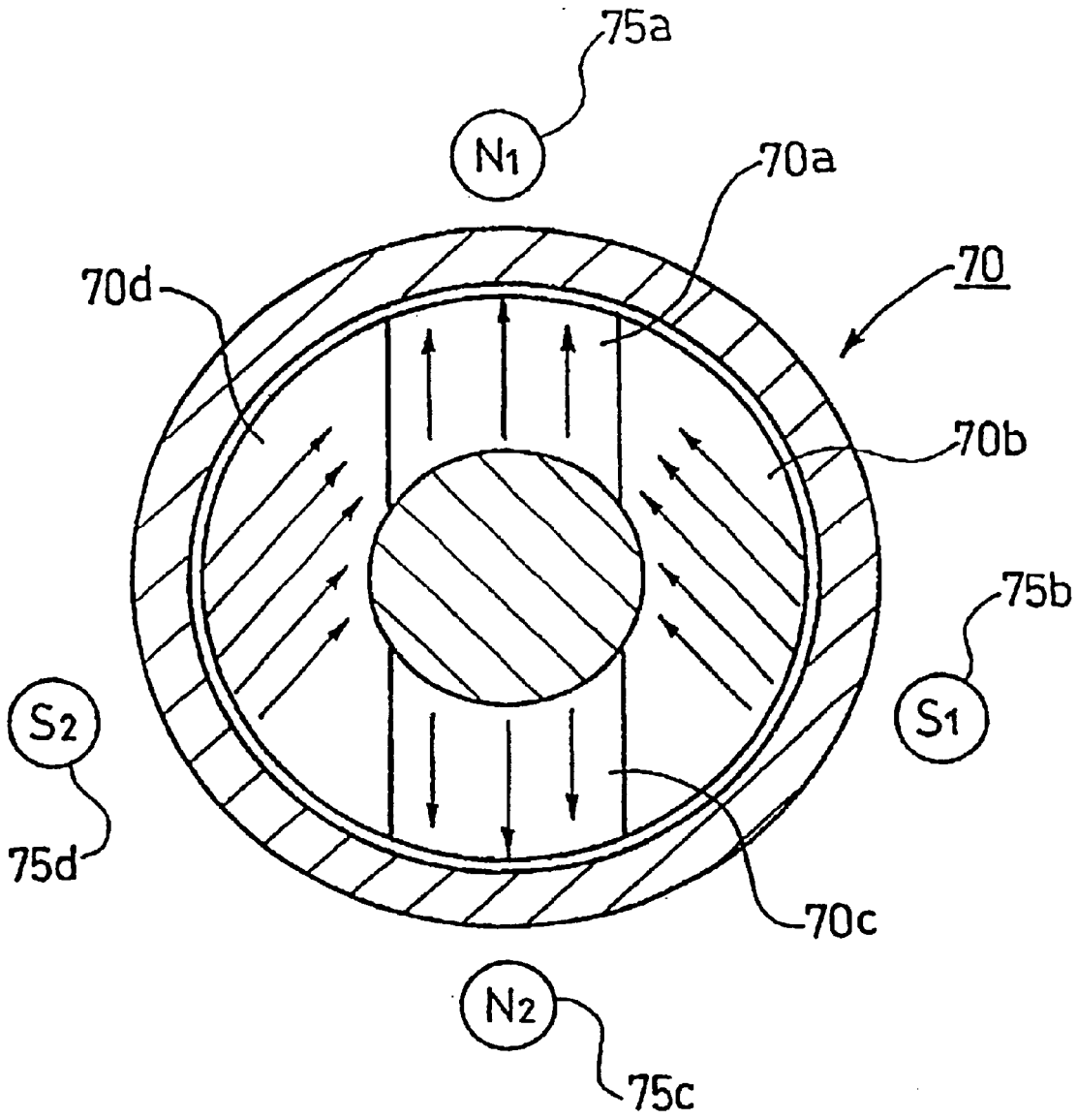
FIG. 6 is a cross-sectional view of a magnet roller illustrating Comparative Example 1.
Figure 7:
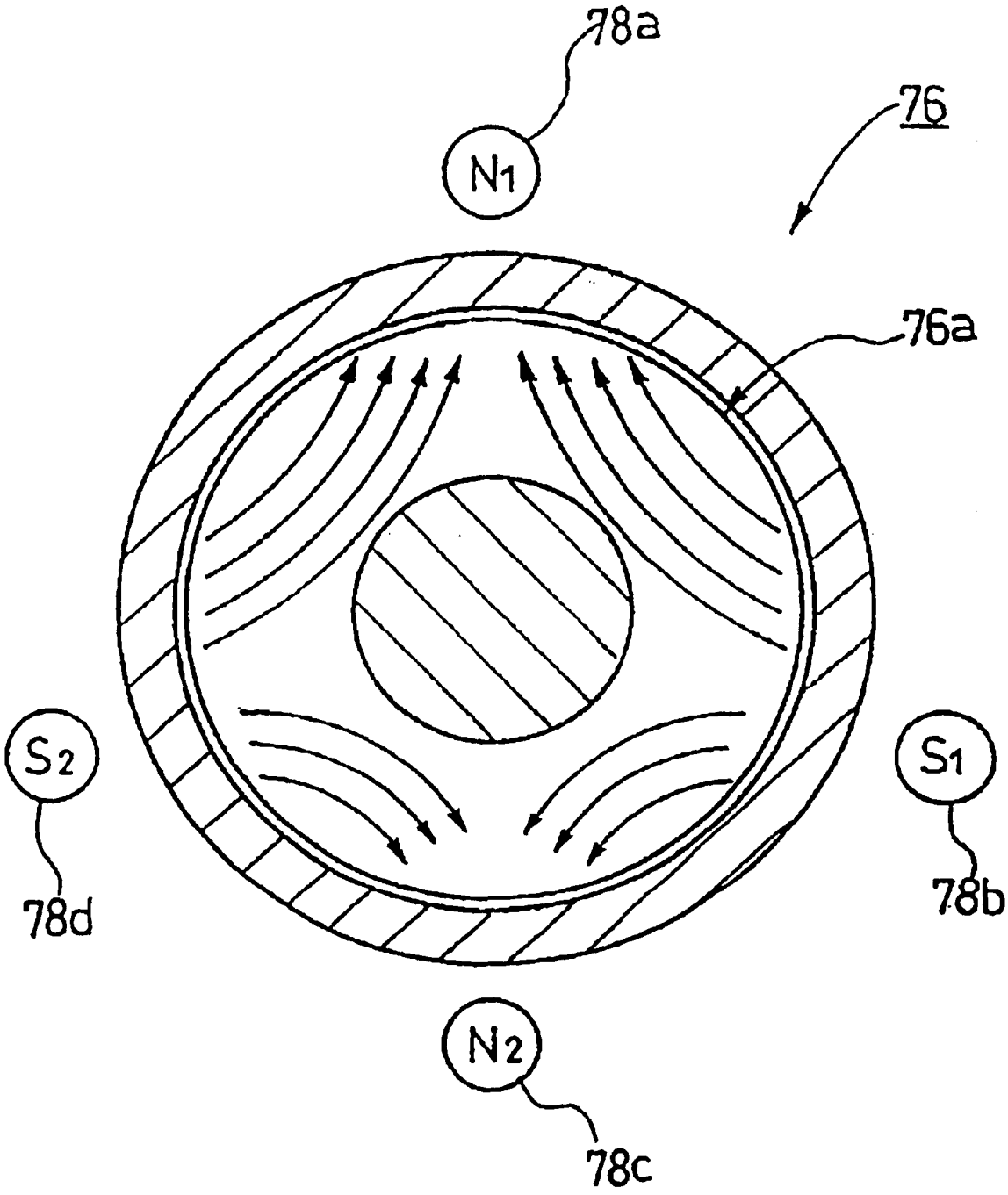
FIG. 7 is a cross-sectional view of a magnet roller illustrating Comparative Example 2.
Figure 8:
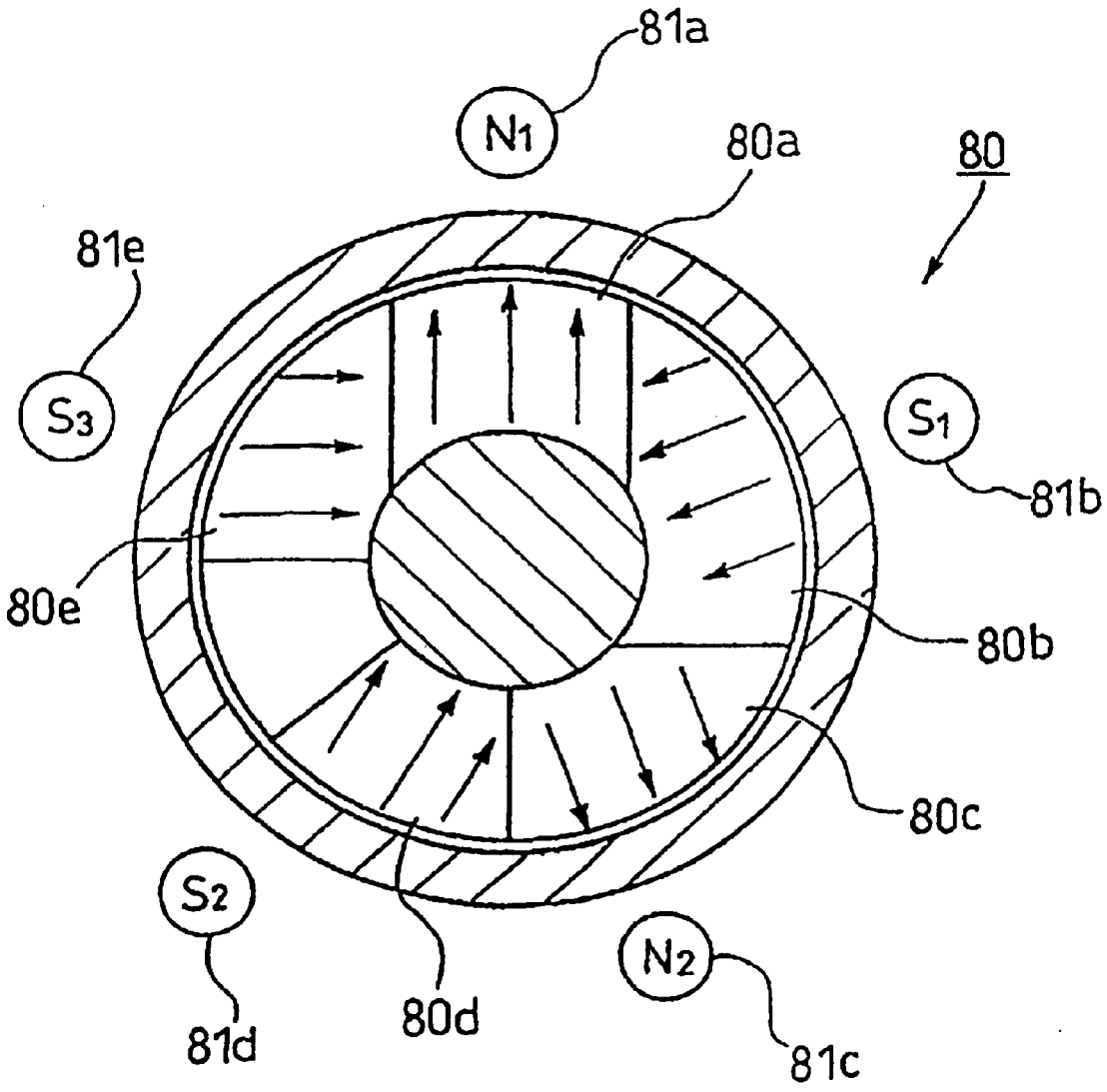
FIG. 8 is a cross-sectional view of a magnet roller Illustrating Comparative Example 3.

Preferred embodiments of the present invention are described below in detail with reference to the drawings. FIG. 1 is a perspective view of a magnet roller illustrating a first embodiment of the present invention. FIG. 2 is likewise a cross-sectional view thereof, showing the magnetic flux density pattern of the magnet roller. FIG. 3 is a cross-sectional view of a magnet roller illustrating a second embodiment of the present invention. FIG. 4 is a cross-sectional view of a magnet roller illustrating a third embodiment of the present invention. FIG. 5 is a cross-sectional view of a magnet roller illustrating a fourth embodiment of the present invention. FIG. 6 is a cross-sectional view of a magnet roller illustrating Comparative Example 1. FIG. 7 is a cross-sectional view of a magnet roller illustrating Comparative Example 2. FIG. 8 is a cross-sectional view of a magnet roller illustrating Comparative Example 3.

As shown in FIG. 1, magnet roller 10 of the first embodiment is constituted by joining first to fourth magnet pieces 12, 14, 16 and 18 to the periphery of shaft 20, and installing these in a freely rotatable cylindrical sleeve 21. The arrangement is such that there is no mutual contact between the inner peripheral surface of the sleeve and the outer peripheral surface of the magnet. The respective joining faces 13, 15, 17 and 19 of the first to second magnet pieces 12, 14, 16 and 18 are made to coincide in the radial direction of the roller and the orientation magnetization directions 22, 24, 26, 28 (see FIG. 2) of adjacent magnet pieces are set in position respectively facing joining faces 13, 15, 17 and 19; peaks 32*a*, 34*a*, 36*a*, 38*a* of magnetic poles 32, 34, 36 and 38 (see FIG. 2) are thereby generated on the lines of extension of joining faces 13, 15, 17 and 19.

The cross-sectional shape of shaft 20 could be any desired shape such as circular, elliptical, square or pentagonal etc and it could be of either magnetic or non-magnetic material.

As shown in FIG. 2, in magnet roller 10, after the first to fourth magnet pieces 12, 14, 16 and 18 have their directions of the magnetization respectively aligned in the directions of arrows 22, 24, 26 and 28, these first to fourth magnet pieces 12, 14, 16 and 18 are joined to the periphery of shaft 20.

Thus, in the first magnet piece 12, the orientation magnetization direction 22 is arranged at 40° with respect to gluing face 12*a* on the side of the N pole and is arranged at 30° with respect to the gluing face 12*b* on the side of the S pole.

In the second magnet piece 14, the orientation magnetization direction 24 is arranged at 80° with respect to gluing face 14*a* on the side of the N pole and is arranged at 30° with respect to the gluing face 14*b* on the side of the S pole.

In the third magnet piece 16, the orientation magnetization direction 26 is arranged at 80° with respect to gluing face 16*a* on the side of the N pole and is arranged at 30° with respect to the gluing face 16*b* on the side of the S pole.

In the fourth magnet piece 18, the orientation magnetization direction 28 is arranged at 40° with respect to gluing face 18*a* on the side of the N pole and is arranged at 30° with respect to the gluing face 18*b* on the side of the S pole.

Consequently, by joining the N pole side gluing face 12*a* of first magnet piece 12 and the N pole side gluing face 18*a* of the fourth magnet piece 18, a repulsive magnetic field is generated at this joining face 13, forming N1 pole (magnetic pole) 32.

Figure 9:
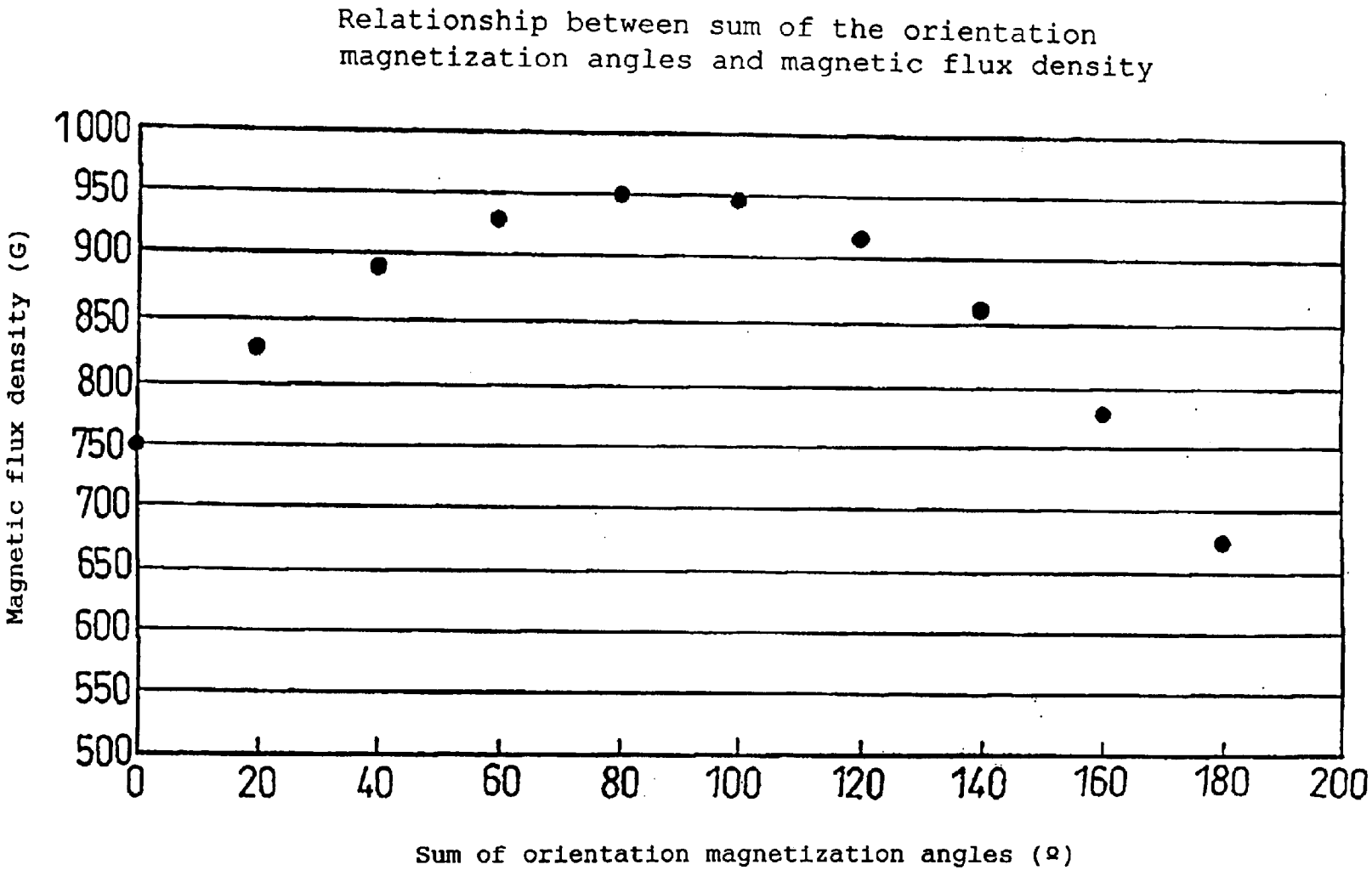
FIG. 9 is a graph showing the relationship of the sum of the orientation magnetization direction of magnetic pieces 12 and 18 and the magnetic flux density in Practical Example 1.

The sum of the orientation magnetization angles is 80° (40°+40°). It was found that the effect of a repulsive magnetic field is generated if the sum of the orientation magnetization angles is 30° or more. With this in view, the magnetic flux density was measured, varying the sum of the orientation magnetization directions by altering the orientation magnetization directions of the magnet pieces 12 and 18 in FIG. 2. As shown in FIG. 9, the result was that it was found that when the sum of the orientation magnetization directions is 30° to 140°, the magnetic flux density is 850 G or more, the greatest repulsive magnetic field being generated when the sum of the orientation magnetization angles was 80°.

Consequently, by setting the sum of the orientation magnetization angles to 80°, a repulsive magnetic field can be generated most efficiently, and the highest peak of the magnetic flux density of N1 pole 32 can be achieved.

Also, by joining the S pole side gluing face 12*b* of first magnetic piece 12 and the S pole side gluing face 14*b* of second magnetic piece 14, a repulsive magnetic field is generated at this joining face 15 and an S1 pole (magnetic pole) 34 is thereby formed.

The sum of the orientation magnetization angles is then 60° (30°+30°). By making the sum of the orientation magnetization angles at least 30°, a repulsive magnetic field can be generated and the magnetic flux density raised.

Furthermore, by joining the N pole side gluing face 14*a* of second magnetic piece 14 and the N pole side gluing face 16*a* of third magnetic piece 16, a repulsive magnetic field is generated at this joining face 17 and an N2 pole (magnetic pole) 36 is thereby formed.

The sum of the orientation magnetization angles is then 160° (80°+80°). By making the sum of the orientation magnetization angles at least 30°, a repulsive magnetic field can be generated and the magnetic flux density raised.

Also, by joining the S pole side gluing face 16*b* of third magnetic piece 16 and the S pole side gluing face 18*b* of fourth magnetic piece 18, a repulsive magnetic field is generated at this joining face 19 and an S2 pole (magnetic pole) 38 is thereby formed.

The sum of the orientation magnetization angles is then 60° (30°+30°). By making the sum of the orientation magnetization angles at least 30°, a repulsive magnetic field can be generated and the magnetic flux density raised.

In magnet roller 10, the joining faces 13, 15, 17 and 19 of the first to fourth magnet pieces 12, 14, 16 and 18 are made to coincide in the radial direction of the roller and the orientation magnetization directions 22, 24, 26, 28 of adjacent magnet pieces are set in position facing joining faces 13, 15, 17 and 19; peaks 32*a*, 34*a*, 36*a*, 38*a* of magnetic poles 32, 34, 36 and 38 can thereby be generated on the lines of extension of joining faces 13, 15, 17 and 19. In this way, by forming magnetic poles 32, 34, 36, 38 by the repulsive magnetic fields at joining faces 13, 15, 17, 19, high magnetic force can be obtained at a plurality of magnetic poles (specified magnetic pole and other magnetic poles) 32, 34, 36, 38.

Furthermore, peaks 32*a*, 34*a*, 36*a*, 38*a* were generated of the magnetic poles 32, 34, 36, 38 on the lines of extension of joining faces 13, 15, 17, 19, by making joining faces 13, 15, 17, 19 of the first to the fourth magnet pieces 12, 14, 16, 18 coincide with the radial directions of the roller. The number (four) of magnet pieces 12, 14, 16 and 18 can therefore be kept to the same number (four) as the number of required magnetic poles 32, 34, 36 and 38.

Next, first to fourth magnet pieces 12, 14, 16 and 18 will be described.

Although in this case the shape of first to fourth magnet pieces 12, 14, 16, 18 is fan shaped, there is no restriction regarding the angle of opening of the fan and this may be suitably set in accordance with the required magnetic flux density and/or shape of the magnetic flux density pattern. Also, the faces of first to fourth magnet pieces 12, 14, 16 and 18 facing the shaft 20 may be suitably set being for example adulate or linear, in accordance with the shape of shaft 20.

Also, regarding the magnetization of the first to fourth magnet pieces 12, 14, 16 and 18, orientation magnetization may be applied concurrently with molding, or magnetization may be effected after molding.

The directions of orientation magnetization of first to fourth magnet pieces 12, 14, 16 and 18 may be set in accordance with the required magnetic flux density and/or shape of the magnetic flux density pattern.

First to fourth magnet pieces 12, 14, 16 and 18 are formed by mixing and dispersing resin binder such as nylon (5 weight % to 50 weight %) with for example strontium-based ferrite magnetic powder (50 weight % to 95 weight %), melting and kneading, molding into pellets, then forming these pellets into fan shape by injection molding or extrusion molding.

If magnetic force higher than that of magnet pieces made of ferrite magnetic powder is required for the first to fourth magnet pieces 12, 14, 16 and 18, a mixed magnetic powder obtained by mixing a magnetic powder constituted by ferrite magnetic powder and a rare earth magnetic powder, or a rare earth magnetic powder on its own may be employed.

Such mixed magnetic powder or rare earth magnetic powder may be applied only to the magnet pieces that are to constitute the magnetic poles where high magnetic force is required, or may be applied to all the magnetic pieces.

Examples of such rare earth magnetic powders are: R (rare earth)-Fe—N based alloys, R—Fe—B based alloys, R—Co based alloys, or R—Fe—Co based alloys etc.

Of these, exchange spring magnetic powders (to be described) including a soft magnetic phase and a hard magnetic phase and having a structure in which there is a mutual exchange action of the magnetization of the two phases are preferred. Exchange spring magnetic powders have a low coercive force (to be described) originating from the soft magnetic phase and have a high residual magnetic flux density (to be described) originating from the mutual exchange action, so they can be made to have a desired high magnetic force and they also have much better resistance to oxidation than conventional rare earth magnetic powders; thus, rusting can be prevented without applying a surface coating such as plating and, in addition, since the exchange spring magnetic powder contains a large quantity of soft magnetic phase, its Curie point is high (400° C. or more), so its limiting temperature of use is high (at least 200° C.) and it shows little temperature dependence of residual magnetization.

As rare earth element R, a combination of one or two or more of preferably Sm or Nd or in addition Pr, Dy, or Tb etc may be employed. Also, in order to improve the magnetic properties by substituting part of the Fe, one or two or more of elements such as Co, Ni, Cu, Zn, Ga, Ge, Al, Si, Sc, Ti, V, Cr, Mn, Zr, Nb, Mo, Tc, Ru, Rh, Pd, Ag, Cd, In, Sn, Sb, Hf, Ta, W, Re, Os, Ir, Pt, Au, Hg, Tl, Pb or Bi may be added.

For the exchange spring magnetic powder it is preferable to employ a powder wherein R—Fe—B compound is employed as the hard magnetic phase and Fe phase or Fe—B compound phase is employed as the soft magnetic layer, or a powder wherein R—Fe—N compound is used as the hard magnetic phase and Fe phase as the soft magnetic layer.

Specifically, exchange spring magnetic powders such as Nd—Fe—B based alloys (soft magnetic phase: Fe—B Alloy, Fe), Sm—Fe—N based alloys (soft magnetic phase: Fe), Nd—Fe—Co—Cu—Nd—B based alloys (soft magnetic phase: Fe—B Alloy, Fe etc), or Nd—Fe—Co based alloys (soft magnetic phase: Fe etc) are preferable.

In particular, from the point of view of making the coercive force (iHc) low and making the residual magnetic flux density (Br) large, Nd4Fe80B20 alloy (soft magnetic phase: Fe—B Alloy, Fe) or Sm2Fe17N3 alloy (soft magnetic phase: Fe) exchange spring magnetic powder is preferable.

Also, as the ferrite magnetic powder, anisotropic or isotropic ferrite magnetic powder having a chemical formula represented by $MO.Fe_2O_3$ may be employed, where, in this formula, for M, a suitable selection is made of one or two or more of for example Sr, Ba or lead.

The magnet pieces are manufactured using magnetic material wherein the mixing the ratio of the above mixed magnetic powder or rare earth magnetic powder and resin binder is magnetic powder: resin binder =(50 weight % to 95 weight %): (5 wt % to 50 weight %); with, if necessary, a silane-based or titanate-based coupling agent added as surface treatment agent, an amide-based lubricating agent added as a lubricating agent to obtain good fluidity of the molten magnetic material, and a stabilizer or flame retardant added to prevent pyrolysis of the resin binder, these constituents then being mixed and dispersed, melted and kneaded, and formed into pellet shape, before injection molding or extrusion molding.

If the content of magnetic powder is less than 50 weight %, the insufficiency of magnetic powder causes the magnetic properties of the magnet roller to be impaired so that the desired high magnetic force is not obtained, and if the content is more than 95 weight %, insufficiency of binder causes the molding properties of the magnet pieces to be impaired.

Examples that may be mentioned of resin binders that may be used include: ethylene-ethylacrylate resin, polyamide, polyethylene, polystyrene, PET (polyethylene terephthalate), PBT (polybutylene terephthalate), PPS (polyphenylene sulfide), EVA (ethylene vinyl acetate), EVOH (ethylene vinyl alcohol), and PVC (polyvinyl chloride) etc; a mixture of one or two or more of these may be employed.

In particular, where the main unit is a resin binder comprising nylon or the like, a resin binder system having flexibility comprising a thermoplastic resin such as PVC, or a thermosetting resin such as epoxy resin or unsaturated polyester resin is even more preferable.

Also, the mixing ratio of the mixed magnetic powder is preferably adjusted to the range rare earth magnetic powder: ferrite magnetic powder=1:9 to 9:1. If the mixing ratio is less than 1:9, only magnetic force on the level of the conventional ferrite resin magnets is obtained, owing to the low content of rare earth magnetic powder; if the mixing ratio is more than 9:1, high magnetic force like that of rare earth resins is obtained, but this is undesirable from the point of view of cost, owing to the high mixing ratio of expensive rare earth magnetic powder.

The terms "coercive force (iHc)", "residual magnetic flux density (Br)" and "exchange spring magnetization" referred to above will now be explained.

As used herein, the term "coercive force (iHc)" means the inherent coercive force (iHc), and is the external magnetic field in opposition to the repulsive magnetic field produced by the residual magnetization when a residual magnetization of half this amount is maintained.

"Residual magnetic flux density (Br)" means the magnetic force from the condition of saturated magnetic flux density i.e. the magnetic flux density when the magnetic field is removed.

"Exchange spring magnetization" means that, when a large amount of soft magnetic phase is present in a magnet, the magnetizations of the crystal grains having soft magnetic characteristics and crystal grains having hard magnetic characteristics are mutually linked by the mutual exchange action, so that inversion of the magnetization of the soft magnetic crystal grains is impeded by the magnetization of the hard magnetic crystal grains, with the result that a characteristic is displayed as if the soft magnetic phase were not present. Thus, since an exchange spring magnet contains a large amount of soft magnetic phase whose residual magnetic flux density is larger than that of the hard magnetic phase (usually a rare earth magnet consists solely of this phase) and whose coercive force is small, a magnet of small coercive force and high residual magnetic flux density is obtained.

As shown in FIG. 3, the magnet roller 40 of the second embodiment comprises first to fourth magnet pieces 42, 14, 16 and 48.

First magnetic piece 42 is subjected to orientation magnetization that converges as shown by arrow 44 from the two faces: S pole side gluing face 42*b* and shaft 20 side bottom face 20*a* towards the apex 43 formed by the N pole side gluing face 42*a* and peripheral face 42*c*.

Also, fourth magnetic piece 48 is subjected to orientation magnetization that converges as shown by arrow 49 from the two faces: S pole side gluing face 48*b* and shaft 20 side bottom face 20*a* towards the apex 42*d* formed by the N pole side gluing face 48*a* and peripheral face 48*c*.

Otherwise, (second magnet piece 14 and third magnet piece 16) it is the same as the first embodiment.

With a magnet roller 40 according to this second embodiment, by making the orientation magnetization directions 44 and 49 of the adjacent magnetic pieces 42 and 48 converge towards the outside (apex 43) of the joining face 45 (joining face of N pole side gluing face 42*a* and N pole side gluing face 48*a*), a repulsive magnetic field can be generated in most efficient manner.

As shown in FIG. 4, magnet roller 50 according to the third embodiment comprises six first to sixth magnet pieces 51, 52, 53, 54, 55 and 56. By setting the orientation magnetization directions of first to sixth magnet pieces 51, 52, 53, 54, 55, and 56 as shown in FIG. 4, three peaks of magnetic flux density are formed on the lines of extension of joining faces 58*a*, 58*b*, 58*c* and two peaks of magnetic flux density are formed at locations which are not on these lines of extension (i.e. a total of five locations).

That is, at six pieces, the number of magnet pieces is one greater than the number of magnetic poles (five) ("number of magnet pieces"="number of magnetic poles +1"). Otherwise, this is the same as the first embodiment.

As shown in FIG. 5, in magnet roller 60 of the fourth embodiment the N pole side gluing face 62*a* of the first magnet piece 62 and the N pole side gluing face 68*a* of the fourth magnet piece 68 are not stuck together, but instead a gap of θ (7° to 15°) is left at the center angle of the magnet roller. Otherwise, this is the same as the first embodiment.

By providing a gap θ between N pole side gluing face 62*a* and N pole side gluing face 68*a*, variations of the shape and dimensions (in particular, angle of opening of the fan) of the magnet pieces can be absorbed. Assembly of magnet roller 60 is thereby facilitated.

θ is set to be less than 15 because if gap θ is made larger than 15° the magnetic resistance becomes large and the magnetic force obtained is lowered.

Next, Practical Examples 1 to 5 and Comparative examples 1 to 4 will be described with reference to Table 1.

TABLE 1

| | Magnetic flux density (G) | | | | | |
|---|---|---|---|---|---|---|
| | N1 pole | S1 pole | N2 pole | S2 pole | S3 pole | |
| Practical Example 1 | 950 G | 700 G | 780 G | 700 G | — | FIG. 2 |
| Practical Example 2 | 970 G | 730 G | 790 G | 720 G | — | FIG. 3 |
| Practical Example 3 | 950 G | 750 G | 900 G | 700 G | 700 G | FIG. 4 |
| Practical Example 4 | 940 G | 700 G | 790 G | 700 G | — | FIG. 5 |
| Practical Example 5 | 900 G | 690 G | 790 G | 690 G | — | FIG. 5 |
| Comparative example 1 | 850 G | 550 G | 650 G | 600 G | — | FIG. 6 |
| Comparative example 2 | 800 G | 600 G | 550 G | 600 G | — | FIG. 7 |
| Comparative Example 3 | 850 G | 750 G | 700 G | 600 G | 550 G | FIG. 8 |
| Comparative Example 4 | 850 G | 680 G | 800 G | 680 G | — | FIG. 5 |

Practical Example 1

Magnet roller 10 of the first embodiment shown in FIG. 2 was manufactured under the following conditions. For the resin binder, 10 weight % of nylon 12 was used and for the magnetic powder 90 weight % of strontium ferrite ($SrO.6Fe_2O_3$) was used; these were mixed, melted and kneaded and molded into pellet shape before being extrusion molded to obtain four first to fourth magnet pieces 12, 14, 16 and 18 as shown in FIG. 2 (diameter ø of external periphery 13.6, diameter ø of internal periphery 6, length 320 mm); concurrently with the molding, these magnet pieces were subjected to orientation magnetization with a magnetic field of 8 KOe to 15 KOe in the directions indicated by arrows 22, 24, 26, 28 (the leading end of the arrow represents the N pole).

Magnet roller 10 was manufactured by gluing these magnet pieces 12, 14, 16 and 18 to shaft 20 (magnetic material: SUM22; outer peripheral face diameter ø: 6) by means of adhesive.

A probe (sensor) was arranged at a location 8 mm distant from the center of the magnet roller 10 obtained, and the peak magnetic force of the respective magnetic poles measured using a gauss-meter whilst rotating magnet roller 10.

As shown in Table 1, the results of the measurement were that it was found possible to make the magnetic flux density of N1 pole 32 highest at 950G, while giving the S1 pole 34, N2 pole 36 and S2 pole 38 the high magnetic flux densities of 700G, 780G and 700G.

Practical Example 2

Magnet roller 40 of the second embodiment shown in FIG. 3 was manufactured under the same conditions as in Practical Example 1.

As shown in Table 1, the results of the measurement were that it was found possible to make the magnetic flux density of N1 pole 49*a* highest at 970G, while giving the S1 pole 49*b*, N2 pole 49*c* and S2 pole 49*d* the high magnetic flux densities of 730G, 790G and 720G.

Practical Example 3

Magnet roller 50 of the third embodiment shown in FIG. 4 was manufactured under the same conditions as in Practical Example 1.

The number of magnet pieces was 6 (number of magnetic poles +1), and the directions of orientation magnetization of the magnet pieces were as shown in FIG. 4; otherwise, this Practical Example was the same as Practical Example 1.

As shown in Table 1, the results of the measurement were that it was found possible to make the magnetic flux density of N1 pole 59*a* highest at 950G, while giving the S1 pole 59*b*, N2 pole 59*c*, S2 pole 59*d* and S3 pole 59*e* the high magnetic flux densities of 750G, 900G, 700G and 700G.

Practical Example 4

Magnet roller 60 of the fourth embodiment shown in FIG. 5 was manufactured under the same conditions as in Practical Example 1.

N pole side gluing face 62*a* of the first magnet piece 62 and the N pole side gluing face 68*a* of the fourth magnet piece 68 are not stuck together, but instead a gap of θ (7°) was left at the center angle of the magnet roller. Otherwise, this Practical Example was the same as the first embodiment.

As shown in Table 1, the results of the measurement were that it was found possible to make the magnetic flux density of N1 pole 69*a* highest at 940G, while giving the S1 pole 69*b*, N2 pole 69*c* and S2 pole 69*d* the high magnetic flux densities of 700G, 790G and 700G.

Practical Example 5

This was manufactured under the same conditions as in Practical Example 4, the difference from Practical Example 4 being that θ was made 15° at the center angle of the magnet roller.

As shown in Table 1, the results of the measurement were that it was found possible to make the magnetic flux density of N1 pole 69*a* highest at 900G, while giving the S1 pole 69*b*, N2 pole 69*c* and S2 pole 69*d* the high magnetic flux densities of 690G, 790G and 690G.

Comparative Example 1

Magnet roller 70 was constructed of the magnet pieces 70*a* to 70*d* shown in FIG. 6. The positions of the magnetic poles (magnetic flux density peak positions) were the same as in the case of Practical Example 1.

As shown in Table 1, the results of the measurement were that the magnetic flux densities of N1 pole 75*a*, S1 pole 75*b*, N2 pole 75*c* and S2 pole 75*d* were respectively 850G, 550G, 650G and 600G.

Comparative Example 2

A magnet roller 76 was constructed with a roller body 76*a* of integrally molded type as shown in FIG. 7. The positions of the magnetic poles (magnetic flux density peak positions) were the same as in the case of Practical Example 1.

As shown in Table 1, the results of the measurement were that the magnetic flux densities of N1 pole 78*a*, S1 pole 78*b*, N2 pole 78*c* and S2 pole 78*d* were respectively 800G, 600G, 550G and 600G.

Comparative Example 3

A magnet roller 80 was constructed of the magnet pieces 50*a* to 80*d* shown in FIG. 8.

As shown in Table 1, the results of the measurement were that the magnetic flux densities of N1 pole 81*a*, S1 pole 81*b*, N2 pole 81*c*, S2 pole 81*d* and S3 pole 81*e* were respectively 850G, 750G, 700G, 600G and 550G.

Comparative Example 4

This was manufactured under the same conditions as in Practical Example 4 shown in FIG. 5, the difference from Practical Example 4 being that θ was made 20° at the center angle of the magnet roller.

As shown in Table 1, the results of the measurement were that the magnetic flux densities of N1 pole 69*a*, S1 pole 69*b*, N2 pole 69*c* and S2 pole 69*d* were respectively 850G, 680G, 800G and 680G.

As is clear from Table 1 by respectively comparing Practical Example 1 and Comparative Example 1, Practical Example 2 and Comparative Example 2, and Practical Example 3 and Comparative Example 3, whereas in the case of Practical Examples 1 to 3, 950G or more was obtained for the N1 pole constituting the specified magnetic pole, in the case of Comparative Examples 1 to 3 only about 800G to 850G could be obtained.

Also in the case of the magnetic poles other than the specified magnetic pole, higher magnetic flux density was obtained in the case of Practical Examples 1 to 3 than in the case of Comparative Examples 1 to 3.

Furthermore, in the case of Practical Examples 4 and 5, instead of sticking together the gluing faces of the magnet pieces constituting the N1 pole (specified magnetic pole), gap θ was set to 7° and 15°. In this case, although the magnetic flux density was somewhat lower than in the case of Practical Example 1, in both cases a magnetic flux density of more than 900G could be ensured, the magnetic flux-density being higher than in the Comparative Examples. Also, in the case of Comparative Example 4, where the gap θ was made 20°, the magnetic flux density was 850G.

As a result, with a magnet roller according to the present invention, the magnetic flux density can be raised to 900G or more at the specified magnetic pole, and can be raised to 700 to 800G or more at the other magnetic poles.

As described above, according to the present invention, as set out in the first phase, in a magnet roller wherein a plurality of magnet pieces are mounted at the periphery of a shaft by joining at joining faces, peaks of magnetic poles are generated on the lines of extension of the joining faces by setting the directions of orientation magnetization of adjacent magnet pieces facing the joining faces, the respective joining faces of the plurality of magnet pieces being made to coincide with roller radial directions of this magnet roller.

With a magnet roller according to the present invention constructed in this way, the respective joining faces of the plurality of magnet pieces are directed in the roller radial directions and the orientation magnetization directions of adjacent magnet pieces are set facing the joining faces. Consequently, repulsive magnetic fields are generated at the joining faces, and the peaks of magnetic poles can be generated on the lines of extension of the joining faces.

By causing the magnetic poles to be formed by the repulsive magnetic fields at the joining faces, high magnetic force can be obtained at a plurality of magnetic poles (specified magnetic pole and other magnetic poles).

Also, the peaks of the magnetic poles are caused to be generated on the lines of extension of the joining faces by directing the respective joining faces of the plurality of magnet pieces in radial directions of the roller. Consequently, the number of magnet pieces can be made the same as the number of magnetic poles required or can be restricted to the number of magnetic poles required +1.

Consequently, the productivity of the magnet roller can be raised, and production costs can be lowered.

According to the present invention, the sum of the angles of the orientation magnetization directions of at least one set of the adjacent magnet pieces is set at 30° to 140°.

By setting the sum of the angles of the orientation magnetization directions of at least one set of the adjacent magnet pieces at 30° to 140°, it can be arranged for the repulsive magnetic field to be generated in the most efficient manner. The magnetic flux density of for example the specified magnetic pole can therefore be made sufficiently large.

According to the present invention, the orientation magnetization directions of at least one set of the adjacent magnet pieces are made to converge towards the outside of the joining face.

By making the orientation magnetization directions of at least one set of the adjacent magnet pieces converge towards the outside of the joining face, it can be made possible to generate a repulsive magnetic field in most efficient manner. The magnetic flux density of for example the specified magnetic pole can thereby be raised even further.

What is claimed is:

1. A magnet roller having joining faces for joining adjacent magnet pieces to each other, comprising a plurality of magnet pieces mounted at the periphery of a shaft by joining at said joining faces to each other, wherein, peaks of magnetic poles are generated on lines of extension where the joining faces join to each other by setting the directions of orientation magnetization of each said magnet piece, relative to the adjacent joining face, at a respective acute angle, wherein two acute angles of the adjacent magnet pieces are adjacent to each other, by converging the directions of orientation magnetization towards an outside of the magnet roller, the respective joining faces that are adjacent to each other, of at least one set of adjacent magnet pieces, being made to coincide with roller radial directions.

2. A magnet roller having joining faces for joining adjacent magnet pieces to each other, comprising a plurality of magnet pieces mounted at the periphery of a shaft by joining at said joining faces to each other, wherein peaks of magnetic poles are generated on lines of extension where the joining faces join to each other by setting the directions of orientation magnetization of each said magnet piece, relative to the adjacent joining face, at a respective acute angle, wherein two acute angles of the adjacent magnet pieces are adjacent to each other.

by setting the sum of the adjacent angles of the orientation magnetization directions of said each magnet piece relative to the respective joining face at 80° or less, the respective joining faces that are adjacent to each other, of at least one set of adjacent magnet pieces, being made to coincide with roller radial directions.

3. The magnet roller according to claim 2, wherein the sum of the adjacent angles of the orientation magnetization directions of said each magnet piece relative to the respective joining face is set at 30° to 80°.

4. The magnet roller according to claim 2, wherein the sum of the adjacent angles of the orientation magnetization directions of said each magnet piece relative to the respective joining face is set at 60° to 80°.

5. The magnet roller according to claim 1, wherein the orientation magnetization directions of the adjacent magnetic pieces converge towards an outside apex of the joining face.

* * * * *